US010470978B2

(12) United States Patent
Zilber

(10) Patent No.: US 10,470,978 B2
(45) Date of Patent: Nov. 12, 2019

(54) FLOW-CONTROLLING PACIFIER WEANING APPARATUS

(71) Applicant: MED ET AL., INC., Matthews, NC (US)

(72) Inventor: David Zilber, Matthews, NC (US)

(73) Assignee: MED ET AL., Matthew, NC (US)

( * ) Notice: Subject to any disclaimer, the term of this patent is extended or adjusted under 35 U.S.C. 154(b) by 624 days.

(21) Appl. No.: 15/026,528

(22) PCT Filed: Sep. 29, 2014

(86) PCT No.: PCT/US2014/058014

§ 371 (c)(1),
(2) Date: Mar. 31, 2016

(87) PCT Pub. No.: WO2015/050813

PCT Pub. Date: Apr. 9, 2015

(65) Prior Publication Data

US 2016/0220449 A1 Aug. 4, 2016

Related U.S. Application Data

(60) Provisional application No. 61/885,277, filed on Oct. 1, 2013.

(51) Int. Cl.

| | |
|---|---|
| ***A61J 11/00*** | (2006.01) |
| ***A61J 17/00*** | (2006.01) |
| ***A61J 7/00*** | (2006.01) |

(52) U.S. Cl.

CPC ..... *A61J 11/002* (2013.01); *A61J 17/001* (2015.05); *A61J 17/006* (2015.05); *A61J 7/0053* (2013.01)

(58) Field of Classification Search

CPC ..... A61J 11/002; A61J 7/0053; A61J 17/001; A61J 17/006

See application file for complete search history.

(56) References Cited

U.S. PATENT DOCUMENTS 3,207,349 A * 9/1965 Rabe ..... A61J 11/0005 215/11.1

4,898,281 A 2/1990 Sailors (Continued)

FOREIGN PATENT DOCUMENTS

DE 20 2005 019 192 U1 3/2006
EP 0 847 744 A2 6/1998

OTHER PUBLICATIONS

International Search Report and Written Opinion dated Jan. 6, 2015 for Application No. PCT/US2014/058014.

(Continued)

*Primary Examiner* — Ashley L Fishback

(74) *Attorney, Agent, or Firm* — Womble Bond Dickinson (US) LLP

(57) ABSTRACT

A pacifier weaning apparatus is provided that includes a shell or shell assembly providing a housing, and a nipple configured to protrude from the housing. The nipple includes a first end adapted to be held by the housing, and an opposing, sucking end adapted for insertion into a user's mouth. The nipple also defines a first chamber and an expandable, second chamber that are both open at the first end and extend in a direction from the first end to the sucking end, and the first chamber being open and the second chamber being closed at the sucking end. And the pacifier weaning apparatus includes an airflow-control component configured to regulate either or both a break pressure at or above which airflow through the first chamber is permitted, or a rate of airflow through the first chamber.

20 Claims, 9 Drawing Sheets

(56) References Cited

U.S. PATENT DOCUMENTS

| | | | |
|---|---|---|---|
| 2003/0083696 | A1 | 8/2003 | Avital |
| 2006/0155331 | A1 | 7/2006 | Bohmer |
| 2008/0177305 | A1 | 7/2008 | Vath et al. |
| 2011/0184460 | A1 | 7/2011 | Hakim |
| 2013/0085475 | A1 | 4/2013 | McNac, III et al. |

OTHER PUBLICATIONS

Supplemental Partial European Search Report dated Mar. 31, 2017 for Application No. EP 14 85 0232.

* cited by examiner

SECTION A-A

SECTION K-K

DETAIL M

SECTION J-J

DETAIL L

SECTION E-E

DETAIL H

28
A
A
30
D
SECTION A-A
36
30
32
34
20
DETAIL D

44
B
B
46
E
SECTION B-B
36
46
48
20
DETAIL E

50
C
C
52
F
SECTION C-C
36
52
20
DETAIL F

SECTION A-A

DETAIL C

SECTION C-C

SECTION B-B

SECTION A-A

SECTION C-C

SECTION B-B

SECTION A-A

SECTION C-C

SECTION D-D

SECTION B-B

SECTION B-B

FLOW-CONTROLLING PACIFIER WEANING APPARATUS

CROSS-REFERENCE TO RELATED APPLICATION(S)

The present application is a national-stage entry of PCT Patent Application No. PCT/US2014/058014, filed on Sep. 29, 2014, which claims priority to U.S. Provisional Patent Application No. 61/885,277, entitled: Flow-Controlling Pacifier Weaning Apparatus, filed on Oct. 1, 2013, the content of which is incorporated herein by reference in its entirety.

FIELD OF THE INVENTION

The present disclosure generally relates to pacifiers, and more particularly, to a flow-controlling pacifier weaning apparatus for discouraging pacifier use by a user such as a child.

BACKGROUND OF THE INVENTION

From birth, all infants have a natural instinct to suck; this is in order to receive nutrition through breast feeding, a behavior which is not only completely normal, but necessary for survival. From the very first time they engage in breast feeding, infants learn that sucking can not only provide valuable nourishment, but also a great deal of pleasure, comfort, and warmth. Whether from a breast or bottle, this behavior, over time, begins to become associated with a very strong, self-soothing, and pleasurable oral sensation.

Parents often appease their children's desire for this stimulating sensation by providing them with pacifiers. Over time, children become acclimated to the comforting presence of pacifiers, specifically the suction, or vacuum, generated when the pacifier is in use.

However, at a certain point in time, it becomes imperative to remove the pacifier in order to prevent the development of both physical and psychological problems, which can include, but are not limited to:

1. Increased risk for ear infection
2. Malocclusion, or overbite, wherein the teeth alignment and jaw formation develop improperly
3. Speech impairments
4. Psychological disorders from teasing and bullying by peers.

Thus, the parents find themselves in an undesirable situation; simply removing the pacifier eliminates the child's ability to self-soothe, and this sudden change can cause a great deal of stress for the child.

Many solutions have been proposed to wean the child from pacifier use, although each has drawbacks.

SUMMARY OF THE INVENTION

Findings indicate that there are three basic principles that apply to pacifier use. The first shows that the suction generated during non-nutritive sucking is the primary motive for engaging in the practice, as all of the pleasure derives from a partial vacuum that is created between the tongue, upper gum, roof of the oral cavity, and the pacifier. The second principle indicates that a child would prefer to suck an object capable of expansion and contraction, whether it is a human breast, bottle, pacifier, or thumb, over an object that does not have the capability; an object which is rigid and incapable of expansion during low-pressure phases and contraction (or relaxation) immediately after, will not be as favorable to the child. The final principle dictates that, after acclimating to the physical shape of the object being sucked, whether pacifier, thumb, or otherwise, the child will reject any other object with sufficiently different physical attributes. This rejection tends to be sudden and can cause considerable stress, comparable to removing the pacifier directly.

Example implementations of the present disclosure provide an improved pacifier apparatus and method that takes into account, simultaneously, the three aforementioned principles that drive non-nutritive sucking. The apparatus is designed for discouraging its use, in a gentle manner which does not result in abrupt rejection and undesirable frustration by a user such as a child. The apparatus is designed to allow an administrator to control, simultaneously, both the ability of the child to expand a hollow chamber of a nipple and the partial vacuum pressure attained by the child during sucking activity, by controlling when and how air flows out of the nipple and into the child's mouth. By incorporating a series of airflow-control components, comprised of valves, passageways, or combinations thereof, the administrator can control both the peak and rhythm of the sinusoid sucking cycle.

According to one aspect of example implementations, a pacifier weaning apparatus is provided that includes a shell or shell assembly providing a housing, and a nipple configured to protrude from the housing. According to this aspect, the nipple includes a first end adapted to be held by the housing, and an opposing, sucking end adapted for insertion into a user's mouth. The nipple defines a first chamber and an expandable, second chamber that are both open at the first end and extend in a direction from the first end to the sucking end, with the first chamber being open and the second chamber being closed at the sucking end. And the pacifier weaning apparatus includes an airflow-control component configured to regulate either or both a break pressure at or above which airflow through the first chamber is permitted, or a rate of airflow through the first chamber.

In some examples, the airflow-control component may include a valve configured to regulate the break pressure, or define a passageway configured to regulate the rate of airflow, or the airflow-control component may both include the valve and define the passageway.

In some examples, the airflow-control component may be configured to fit within the housing proximate the first end of the nipple. In some further examples, the airflow-control component may be removable from the housing and interchangeable with one or more additional airflow-control components each of which is also configured to fit within the housing. Similar to before, the airflow-control component and one or more additional airflow-control components may structurally define different, respective break pressures or rates of airflow. In other further examples, the airflow-control component may be removable from the housing and provide an adjustable break pressure or rate of airflow (or both).

In some examples, the airflow-control component may include a removable valve assembly securable to the housing. In these examples, the removable valve assembly may include an outer valve housing and a spring-loaded valve. The outer valve housing may be securable to the housing and define an aperture. And the spring-loaded valve may be configured to push upon the aperture with an adjustable force, and thereby an adjustable break pressure at which airflow through the aperture and first chamber is permitted. In some examples, the diameter of the aperture or a passageway from the aperture through the valve housing may define the airflow rate through the open-ended chamber.

In some further examples, the outer valve housing may include an interior within which the spring-loaded valve is configured to fit, and the spring-loaded valve may include a spring and a structure such as a ball. In these further examples, the removable valve assembly may further include an inner member configured to move axially within the interior of the outer valve housing with the spring-loaded valve between the aperture and inner member. Adjustment of the inner member, then, may alter compression of the spring and thereby a force that the structure pushes upon the aperture.

In some further examples, the inner member may be configured to thread onto the outside of the outer valve housing, with the spring-loaded valve between the aperture and the outer member.

According to another aspect of example implementations, a pacifier weaning apparatus is provided that includes a shell or shell assembly providing a housing, and a nipple configured to protrude from the housing. Similar to before, the nipple of this other aspect includes a first end adapted to be held by the housing, and an opposing, sucking end adapted for insertion into a user's mouth. The nipple defines a first chamber and an expandable, second chamber that are both open at the first end and extend in a direction from the first end to the sucking end, with the first chamber being open and the second chamber being closed at the sucking end.

According to this other aspect, the housing defines a recess that opens opposite the nipple when held by the housing. The recess is configured to hold a plurality of interchangeable accessories including a removable airflow-control component or an attachment for delivery of food through the housing and first chamber. The airflow-control component is configured to regulate either or both a break pressure at or above which airflow through the first chamber is permitted, or a rate of airflow through the first chamber.

In some examples, the pacifier weaning apparatus may further include an insert configured to fit in the recess of the housing and fasten the nipple to the housing. In these examples, the insert may define a recess configured to hold the removable airflow-control component or attachment. And in some further examples, the insert may include a lid for locking the removable airflow-control component in place when held in the recess defined by the insert. Or in some examples, the removable airflow-control component or attachment may be removably securable at least partially within the recess defined by the housing.

In some examples, the recess defined by the housing is configured to hold a plurality of interchangeable, removable airflow-control components. Similar to above, the plurality of removable airflow-control components may structurally define different, respective break pressures at which airflow through the first chamber is permitted, or rates of airflow through the first chamber.

According to other aspects of example implementations of the present disclosure, airflow-control components for pacifier weaning apparatuses are provided. Example implementations of the present disclosure therefore provide improved apparatuses for controlling the flow of air to break the partial vacuum, in a manner which maximizes apparatus adoption and minimizes rejection. As indicated above and explained below, example implementations of the present disclosure may provide one or more advantages over existing techniques.

BRIEF DESCRIPTION OF THE DRAWINGS

Figure 1B:
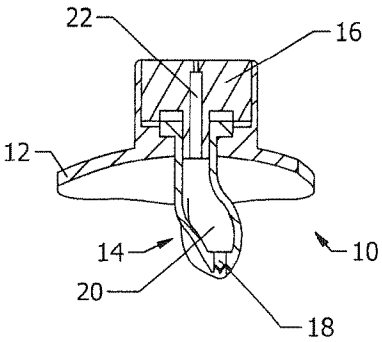
Figure 1D:
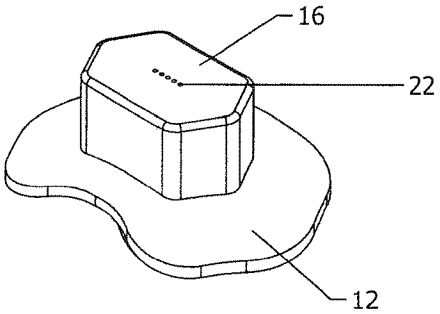
Figure 1A:
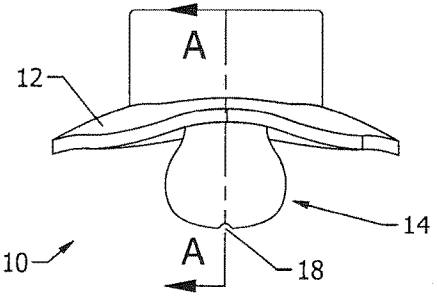
Figure 1C:
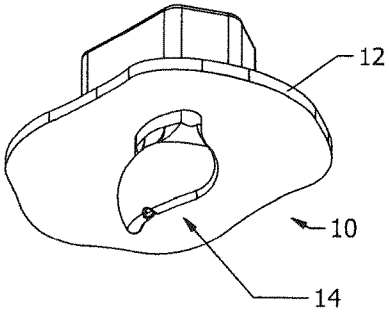
Figure 4A:
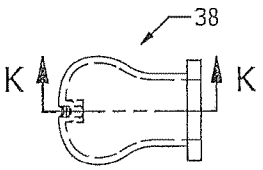
Figure 4B:
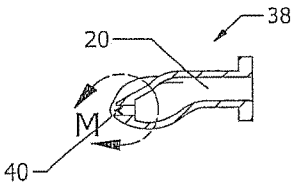
Figure 4C:
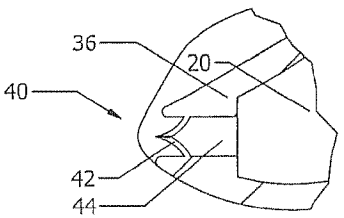
Figure 3A:
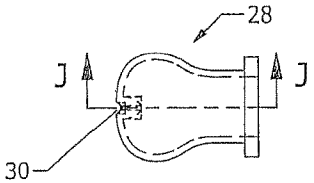
Figure 3B:
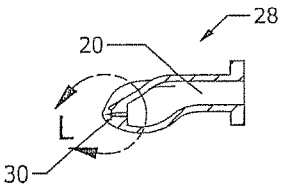
Figure 3C:
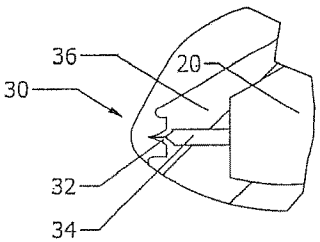
Figure 2A:
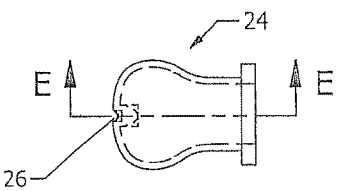
Figure 2B:
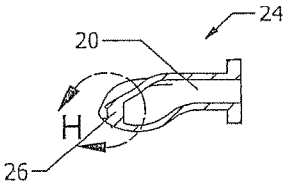
Figure 2C:
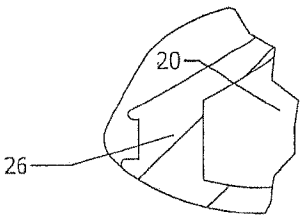
Figures 5A, 5B, 5C:
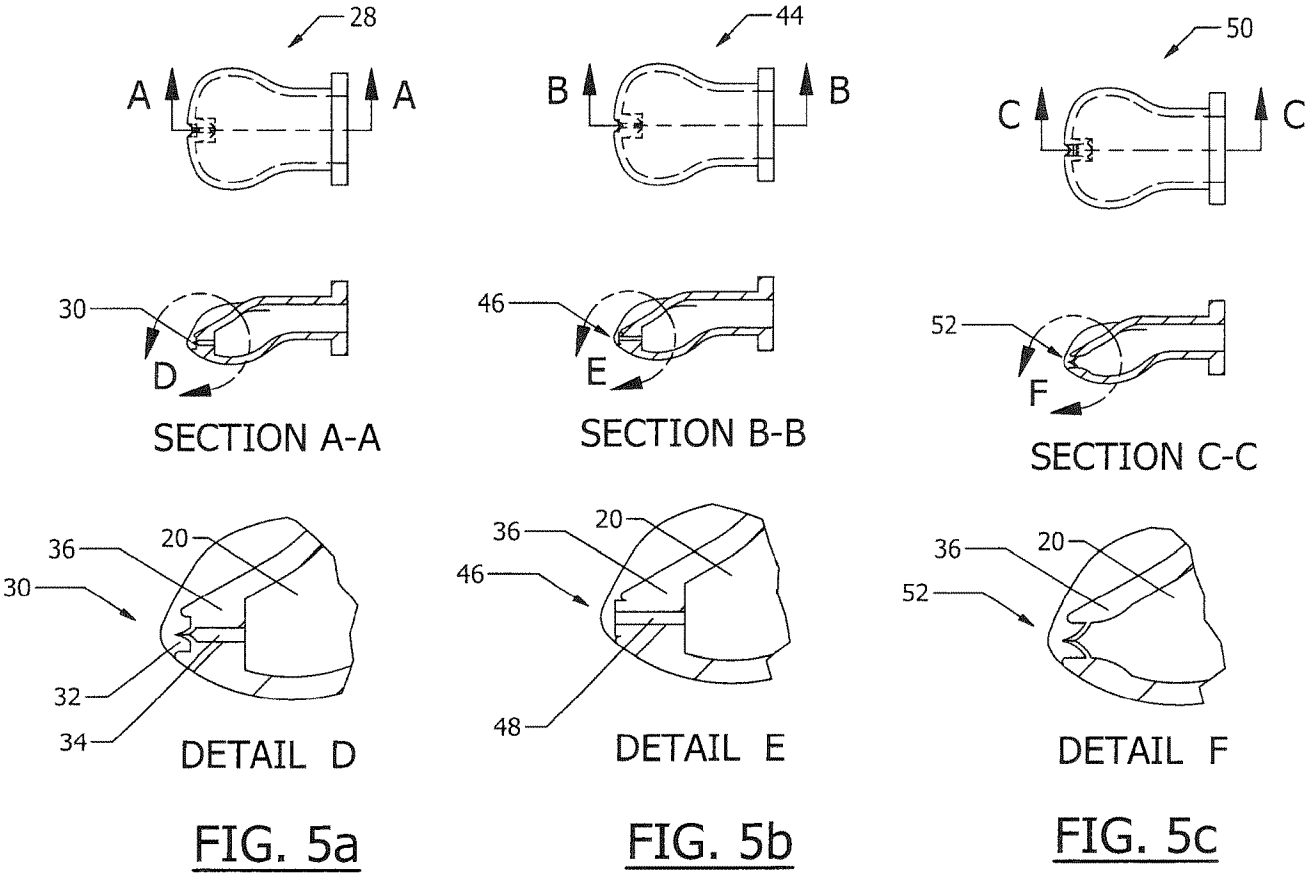
Figure 6A:
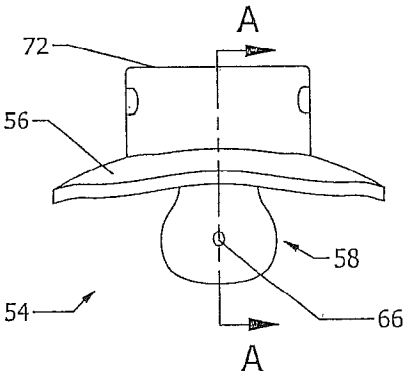
Figure 6B:
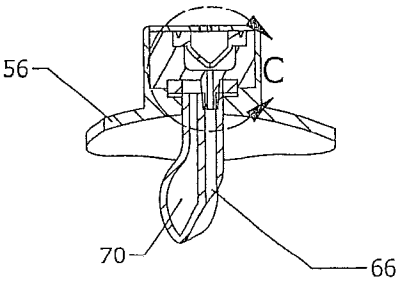
Figure 6C:
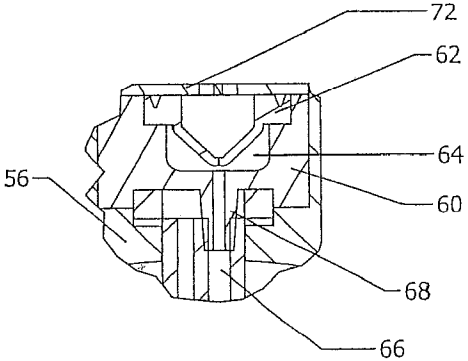
Figure 6D:
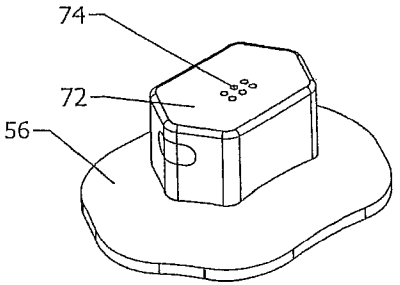
Figure 6E:
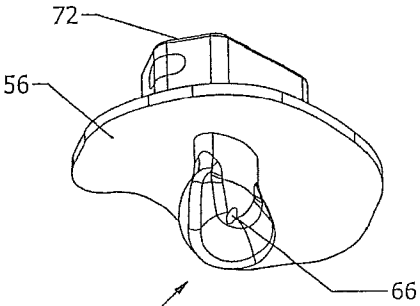
Figure 9A:
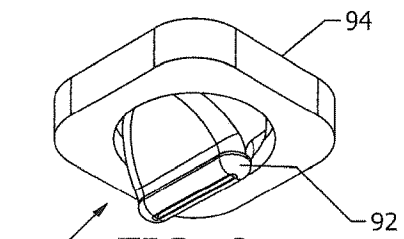
Figure 9B:
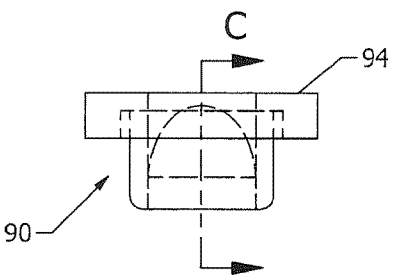
Figure 9C:
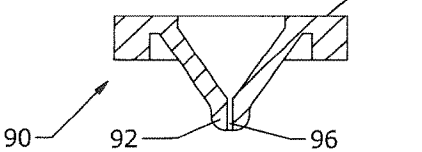
Figure 8A:
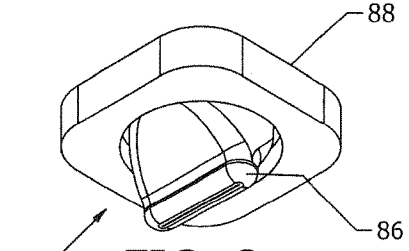
Figure 8B:
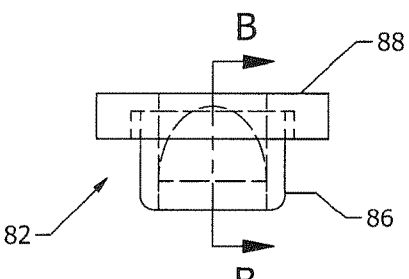
Figure 8C:
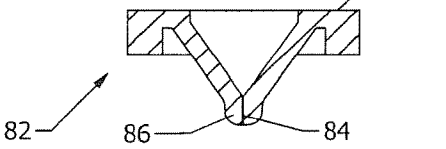
Figure 7A:
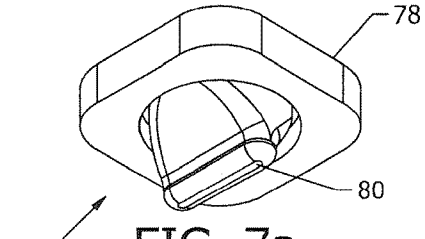
Figure 7B:
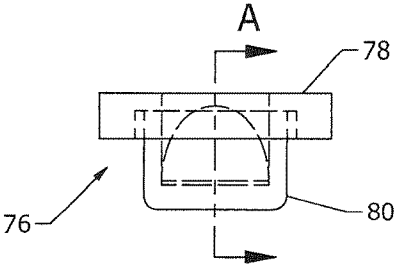
Figure 7C:
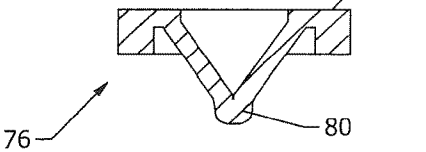
Figure 10C:
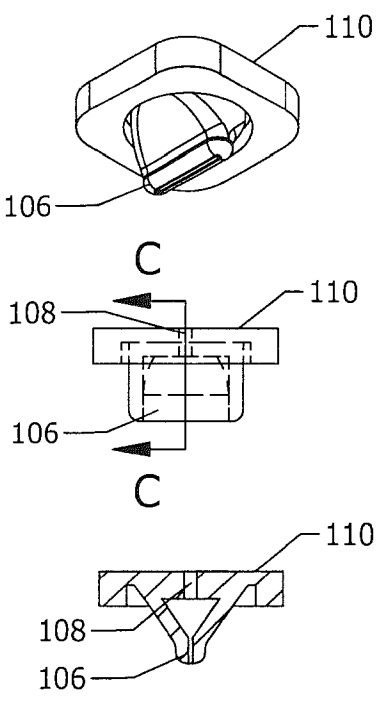
Figure 10B:
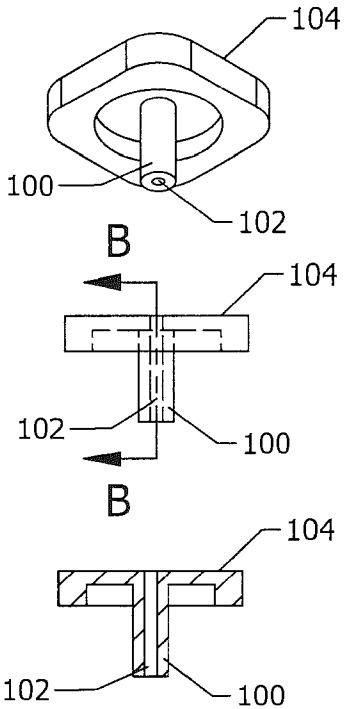
Figure 10A:
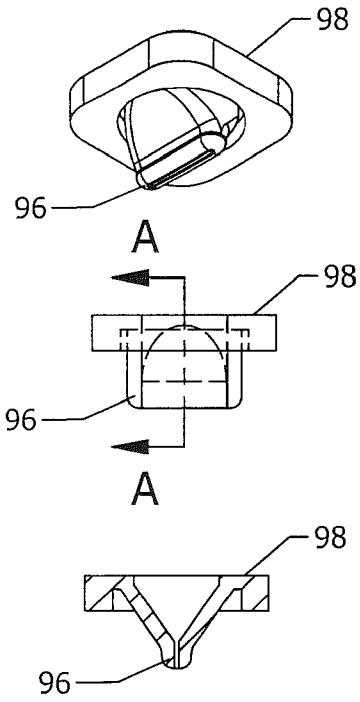
Figure 11C:
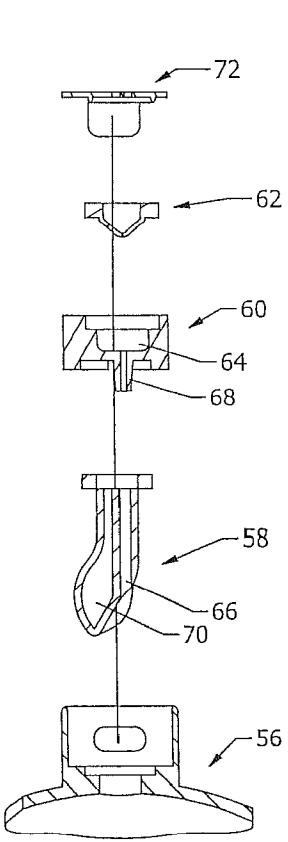
Figure 11B:
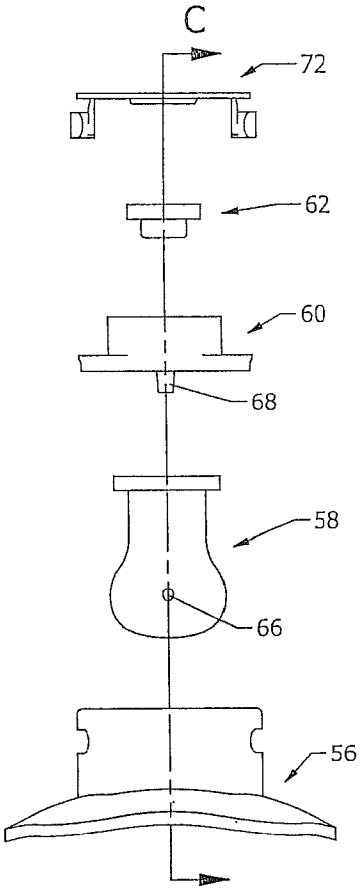
Figure 11A:
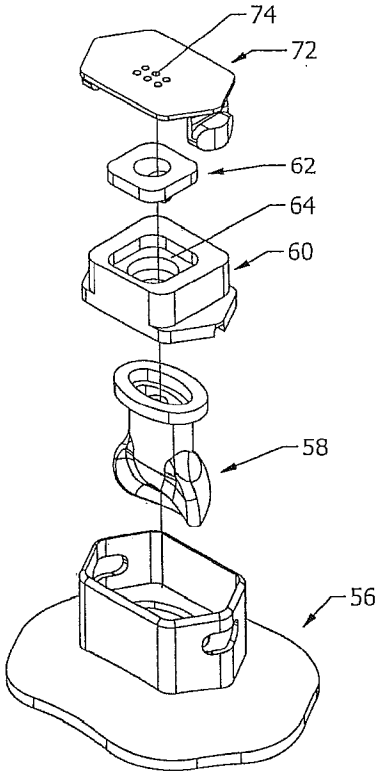
Figure 12D:
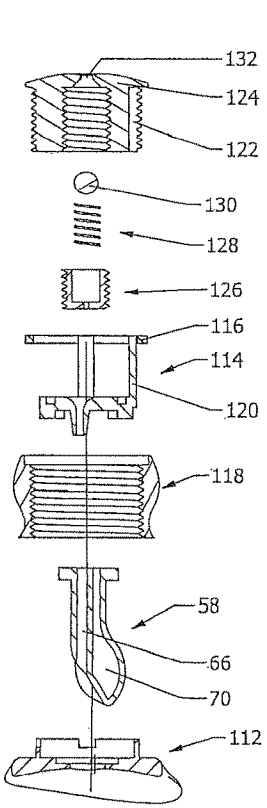
Figure 12C:
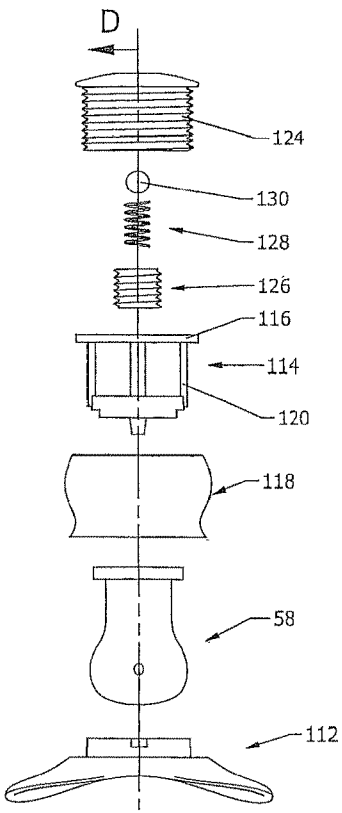
Figure 12B:
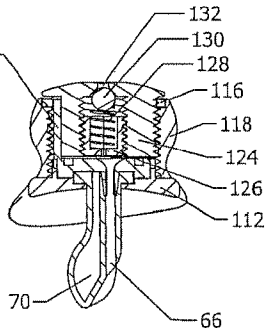
Figure 12A:
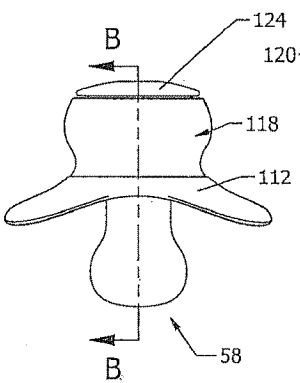
Figure 13B:
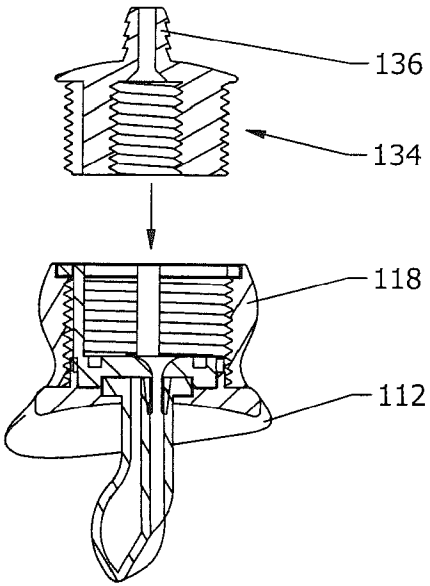
Figure 13A:
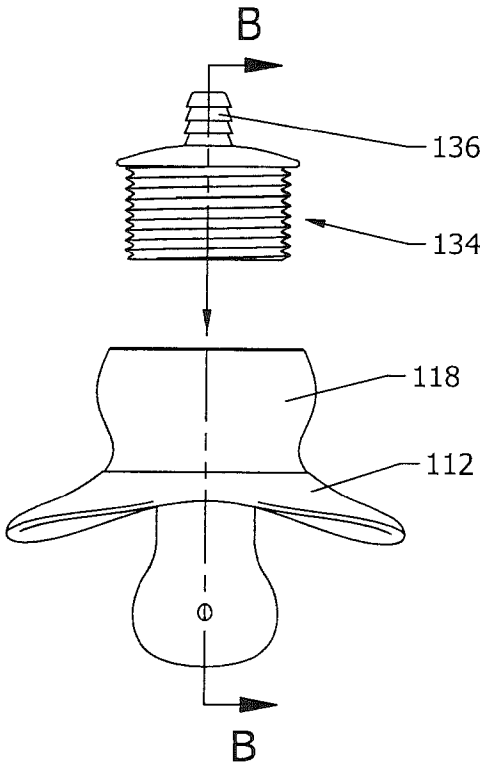

Having thus described the invention in general terms, reference will now be made to the accompanying drawings, which are not necessarily drawn to scale, and wherein:

FIGS. 1*a*-1*d* (collectively FIG. 1) illustrate respectively a side view, side cross-section view, perspective bottom-up view, and a perspective top down view of a pacifier assembly including a nipple and an integrated airflow-control component, according to example implementations of the present disclosure;

FIGS. 2*a*, 2*b* and 2*c* (collectively FIG. 2) illustrate respectively a side view, side cross-section view, and a detail of the cross-section view of an apparatus including a single-chambered pacifier nipple used in a first stage of a weaning process, according to one example implementation;

FIGS. 3*a*, 3*b* and 3*c* (collectively FIG. 3) illustrate respectively a side view, side cross-section view, and a detail of the cross-section view of an apparatus including a single-chambered pacifier nipple used in an intermediary stage of the weaning process, according to one example implementation;

FIGS. 4*a*, 4*b* and 4*c* (collectively FIG. 4) illustrate respectively a side view, side cross-section view, and a detail of the cross-section view of an apparatus including a single-chambered pacifier nipple used in an advanced stage of the weaning process, according to one example implementation;

FIGS. 5*a*, 5*b* and 5*c* (collectively FIG. 5) illustrate various views of numerous implementations of embedded airflow-control components, according to example implementations;

FIGS. 6*a*-6*e* (collectively FIG. 6) illustrate respectively a side view, side cross-section view, detail side cross-section view, a perspective top down view, and a perspective bottom-up view of a pacifier assembly including an interchangeable airflow-control component, according to example implementations;

FIGS. 7*a*, 7*b* and 7*c* (collectively FIG. 7) illustrate respectively a perspective bottom up view, a side view, and a side cross-section view of an apparatus including an interchangeable airflow-control component used in a first stage of a weaning process, according to one example implementation;

FIGS. 8*a*, 8*b* and 8*c* (collectively FIG. 8) illustrate respectively a perspective bottom up view, a side view, and a side cross-section view of an apparatus including an interchangeable airflow-control component used in an intermediary stage of the weaning process, according to one example implementation;

FIGS. 9*a*, 9*b* and 9*c* (collectively FIG. 9) illustrate respectively a perspective bottom up view, a side view, and a side cross-section view of an apparatus including an interchangeable airflow-control component used in an advanced stage of the weaning process, according to one example implementation;

FIGS. 10*a*, 10*b* and 10*c* (collectively FIG. 10) illustrate various views of numerous implementations of interchangeable airflow-control components, according to example implementations;

FIGS. 11*a*, 11*b* and 11*c* (collectively FIG. 11) illustrate respectively a perspective top-down view of the exploded assembly, side view of the exploded assembly, and a side-cross section view of the exploded assembly of a pacifier assembly including an interchangeable airflow-control component, according to example implementations;

FIGS. 12*a*-12*d* (collectively FIG. 12) illustrate respectively a side view, a side cross section view, side view of the exploded assembly, and a side-cross section view of the exploded assembly of a pacifier assembly including a removable valve assembly with an adjustable air flow-control component, according to example implementations; and FIGS. 13*a* and 13*b* (collectively FIG. 13) illustrate respectively a side view and a side cross-section view of an accessory feeding attachment used in lieu of the valve assembly, in conjunction with a pacifier assembly, according to example implementations.

DETAILED DESCRIPTION OF THE INVENTION

The present disclosure now will be described more fully hereinafter with reference to the accompanying drawings, in which preferred implementations of the disclosure are shown. This disclosure may, however, be embodied in many different forms and should not be construed as limited to the implementations set forth herein; rather, these implementations are provided so that this disclosure will be thorough and complete, and will fully convey the scope of the disclosure to those skilled in the art. For example, references may be made herein to directions and orientations including vertical, horizontal, diagonal, right and left, front and back; it should be understood, however, that any direction and orientation references are simply examples and that any particular direction or orientation may depend on the particular object, and/or the orientation of the particular object, with which the direction or orientation reference is made. Like numbers refer to like elements throughout.

FIG. 1 (including FIGS. 1*a*-1*d*) illustrates various views of an assembled pacifier weaning apparatus 10 (sometimes referred to as a pacifier weaning device) according to an example implementation of the present disclosure. As shown, the pacifier weaning device may include a pacifier shell 12, a pacifier nipple 14, an insert 16, and a vacuum-breaking airflow-control component 18. As also shown, the pacifier nipple may define an expandable pacifier chamber 20.

The pacifier shell 12 defines a body of the pacifier weaning device 10, and may contain a pacifier shield to prevent swallowing, and subsequent choking, of the pacifier weaning device, by a user such as a child. The pacifier shell provides housing for the other components, including the nipple 14 and the insert 16, which may affix the nipple in place.

The pacifier nipple 14 protrudes from the pacifier shell 12, and is constructed out of a material which may be pleasant for the user to suck. It is secured in place and cannot be removed from the pacifier shell. The nipple may be directly responsible for the pleasure derived during pacifier use by the user. In order to prevent rejection of the pacifier, physical attributes of the pacifier are anatomically pleasing to the user, when in use, the nipple at least partially expands and contracts to provide a sensation similar to what the user instinctively craves; namely, that of breastfeeding. In this regard, the nipple may be designed to at least partially expand under negative pressure until a certain internal break pressure is reached. This is in contrast to a nipple which unconditionally permits free flowing air through it, without the ability to expand/contract, which may result in its collapse upon sucking, and not generate any sort of pleasurable sensation for the user.

The pacifier chamber 20 is defined as a hollowed chamber in the nipple 14 of the pacifier weaning device 10, which nipple may be elastic and capable of expansion during a partial vacuum, such as during peak suction, and is then capable of relaxation thereafter. The chamber defines at least one open end for air to flow in, to permit expansion, and the same open end allows air to flow out, to permit relaxation.

The insert 16 may fit within a recess defined in the pacifier shell 12, and may securely fasten the pacifier nipple 14 to the pacifier shell. This may be accomplished by affixing a sufficiently large area of the insert to the pacifier shell, and thereby sandwiching a pacifier nipple between. As described below, air may flow into and out of the pacifier nipple or more particularly its expandable pacifier chamber 20. In some examples, following sufficient use, moisture may accumulate inside of the pacifier nipple, which may necessitate cleaning of the device. This may be accomplished by selectively removing a section of the lid which would grant access to internal surfaces of the pacifier weaning device 10.

The airflow-control component 18 may be incorporated into a sucking end of the pacifier nipple 14, and provide a means for air to flow out of the expandable pacifier chamber 20, in a precisely controlled manner, thereby collapsing the chamber, and disrupting the partial vacuum which has developed during the sucking phase. For example, the airflow-control component may include either or both of a pressure-control valve or flow-control passageway, which may permit a controllable flow of air when a controllable pressure condition is met, such as when the intensity of the sucking by the user reaches a certain threshold. Immediately after the valve opens and the chamber collapses, the user may resume sucking, thereby drawing air from an attached end of the nipple, through holes 22 defined in the insert 16. The air drawn through the holes may flow into the chamber, thereby expanding it, in order to provide the satisfactory sensation of expansion for the user, during a state of a partial vacuum with increasing negative pressure inside of the chamber.

The valve of the airflow-control component 18 may be configured to regulate a break pressure such that airflow is permitted only at or above a defined break pressure. And the passageway of the airflow-control component may be configured to regulate airflow such that airflow is permitted only at or below a defined flow rate. By defining the break pressure and flow rate, the amount of air that breaks the suction and the moment it begins to flow can be controlled in an incremental fashion, allowing for sufficiently fine resolution among stages of a weaning process.

In some examples, the airflow-control component 18 may be embedded in the pacifier nipple 14, in which case the user may administer step through stages of the weaning process by replacing the entire pacifier weaning device 10. In other examples, the airflow-control component may be removable and interchangeable, to be inserted into and removed from the insert 16, in which case the user may step through stages of the weaning process by removing a stage-specific airflow-control component from a recess in the insert, and replacing it with another stage-specific airflow-control component.

FIGS. 2, 3 and 4 illustrate examples of suitable single-chambered pacifier nipples that may be used for the pacifier nipple 14 in various stages of a weaning process according to example implementations of the present disclosure.

FIG. 2 (including FIGS. 2*a*-2*c*) illustrates various views of a single-chambered pacifier nipple 24 that may be used in a first stage and perhaps one or more other initial stages of the weaning process, when maximum expansion and sufficiently greater partial vacuum pressures are desired. As shown, the nipple of this example implementation generally has an airflow-control component 26. As shown in FIG. 2*a*, the airflow-control component may be embedded on the sucking end, opposite a flange for securing the nipple. The airflow-control component for this particular stage of the weaning process may be fully sealed, or otherwise configured to permit negligible airflow, which allows the expandable chamber 20 the ability to reach maximum expansion. In one example, the airflow-control component may include either or both of a valve or passageway configured to permit the flow of air only at a significantly high pre-determined break pressure (as regulated by the valve) and at a predetermined flow rate (as regulated by the passageway), though in this implementation, it may be sealed.

FIG. 3 (including FIGS. 3*a*-3*c*) illustrates various views of a single-chambered pacifier nipple 28 that may be used in one or more intermediary stages of the weaning process. As shown, the outwardly appearance of the nipple shown in FIG. 3 is generally similar to the nipple shown in FIG. 2, but with an airflow-control component 30 configured to permit an incrementally different break pressure, airflow, or combination thereof. This may permit the pacifier chamber 20 to expand to a defined threshold but may then be able to collapse at an intermediary break pressure, in order to allow desirable expansion of the pacifier chamber and also a partial vacuum within the user's mouth. This particular airflow-control component may include a valve 32 and a passageway 34.

In some examples, the valve 32 may be a duckbill, umbrella, or any other check valve. The valve may permit the flow of air only once a specific threshold is reached; namely, the break pressure, where the sucking force is high enough to collapse the valve. The passageway 34 may permit a specific amount of air to flow when the valve may open at the preferred break pressure. The nipple 28 may include a portion 36 sufficiently reinforced to prevent collapse of the valve due to normal physical deflection or manipulation by the tongue, roof of mouth, or combination thereof, and operate such that it can only be opened when the negative pressure inside of the pacifier chamber exceeds an anticipated threshold.

FIG. 4 (including FIGS. 4-4*c*) illustrates various views of a single-chambered pacifier nipple 38 that may be used in one or more advanced stages of the weaning process. As shown, the nipple may include an airflow-control component 40 with a valve 42 and passageway 44. The outwardly appearance of the nipple shown in FIG. 4 is generally similar to the nipples shown in FIGS. 2 and 3, but with the airflow-control component 40 being configured to permit a further lower break pressure, greater airflow, or combination thereof. This may permit the pacifier chamber 20 to expand to a relatively lower defined threshold but may then be able to collapse at a lower relative break pressure, in order to prevent the formation of sufficiently high partial vacuums. In order to prevent unwanted operation of the airflow-control component, the nipple may include a portion 36 sufficiently reinforced to prevent collapse of the valve due to normal physical deflection or manipulation by the tongue, roof of mouth, or combination thereof, and operate such that it can only be opened when the sucking force of the user causes the chamber to exceed an anticipated threshold. The valve may open at a lower preferred break pressure, relative to the pacifier nipple shown in FIG. 3*a*, thereby permitting a flow of air through the passageway, the size of which may define the flow rate.

In one example of a weaning process according to example implementations of the present disclosure, the administrator may choose the pacifier weaning device 10, which has a nipple 24 with integrated airflow-control component 26 corresponding to a first stage of the weaning process, such as shown in FIG. 2. The pacifier weaning device may include some form of indication, whether by color, number, or written markings, of its designated use as the first device in the weaning process. After sufficient time, the administrator may replace the first pacifier weaning device (FIG. 2) with a second pacifier weaning device (FIG. 3), which contains a nipple 28 with an integrated airflow-control component 30 of incremental alteration, whether by break pressure, airflow, or combination thereof. After another sufficient period of time has elapsed, a third pacifier (FIG. 4) with nipple 38 that contains an integrated airflow-control component 40 of a relative incremental difference may replace the second (FIG. 3), and so on, until the last pacifier does not permit any sort of pleasurable sucking activity from the user, and the user ceases to engage in the habit altogether.

FIG. 5 (including FIGS. 5*a*-5*c*) illustrates various example implementations of a nipple and an integrated airflow-control component according to example implementations. FIG. 5*a* shows various views of the nipple 28 with embedded airflow-control component 30 that is defined by a combination of valve 32 and passageway 34, which may correspond to those depicted in FIG. 3. It is to be understood that any combination of valves and passageways, in any order, and with any multitude of each, can be implemented in example implementations of the present disclosure. FIG. 5*b* shows various views of a nipple 44 with embedded airflow-control component 46 that is defined by a single passageway 48, of defined length and diameter. FIG. 5*c* shows various views of a nipple 50 with embedded airflow-control component 52 that is defined by a single valve, which may be a duckbill, umbrella, or any other type of valve.

It is to be understood that any physical incremental differences between the nipples and airflow-control components employed heretofore could include the aforementioned and/or any other incremental differences. Examples of other incremental differences include a material of different hardness, diaphragm of different length, passageway of different size diameter or length, or the like, to achieve the same desired effect of modifying the break pressure, nipple expansion, partial vacuum, or combination thereof. Regardless of the implementation and type of airflow-control components utilized, as explained above, one or more of the nipples may additionally include a reinforced portion 36 to prevent collapse of the component due to physical perturbations, and an expandable chamber 20 to provide pleasurable sensation to the user.

FIG. 6 (including FIGS. 6*a*-6*e*) illustrates various views of a pacifier weaning device 54 of one example implementation, which may be assembled from a pacifier weaning kit that may include or be otherwise designed to utilize a plurality of airflow-control components, which may be selectively chosen, inserted, and replaced within the pacifier weaning device, or more particularly a pacifier shell 56 of the pacifier weaning device.

Similar to before, the pacifier weaning device 54 includes a pacifier shell 56 which serves as a housing for other components and affixes a nipple 58 to an insert 60, which may fit within a recess defined in the pacifier shell. Also as before, the pacifier weaning device may include an airflow-control component 62. In this example, the airflow-control component is not embedded into the nipple, but rather, is a separate, removable unit that can be inserted into, and secured within, a recess 64 defined by the insert. This may be done in such a way as to prevent removal by the user, and also provide a means for air to flow according to the corresponding stage of the weaning process.

As shown and described herein, the nipple 58 of the example shown in FIG. 6 may be constructed such that one end of an open-ended (first) chamber 66 may interface with the insert 60 which has a connecting port 68. When assembled, the port may be inserted into the end of the open-ended chamber opposite the sucking end, which may expand the channel and create a seal. In some examples, the port to be inserted into the channel may be barbed to facilitate creation of the seal. The other end of the open-ended chamber may terminate in the sucking end of the nipple, which may include another (second) chamber 70, which may be sealed at the sucking end, and thus may provide the ability for expansion and contraction. The insert may contain the aforementioned recess 64 for secure placement of the airflow-control component 62. An additional lid component 72 may provide a means to lock the airflow-control component in place, and may seal the airflow-control component to prevent undesirable flow of air outside of the airflow-control component. The lid component may contain a means for air to flow into the airflow-control component, such as, but not limited to, a series of holes or apertures 74.

FIGS. 7, 8 and 9 illustrate examples of suitable interchangeable airflow-control components that may be used for the airflow-control component 60 in various stages of a weaning process, according to example implementations. In some examples, the airflow-control component may include a base defining an opening, and a valve disposed over the opening, a hollow structure defining a passageway from the opening, or both the valve and component.

FIG. 7 (including FIG. 7*a*-7*c*) show various views of the interchangeable airflow-control component 76 of one example implementation, which may be used in a first stage and perhaps one or more other initial stages of the weaning process. Similar to before, various types of airflow-control components can be used, which can include, but are not limited to, check valves (such as duckbill valves, umbrella valves, etc.), passageways, or combinations thereof, which may be disposed relative to an opening defined by a base of the airflow-control component.

FIG. 7*a* illustrates the airflow-control component 76 including a base 78 that defines an opening, and that includes a sealed duckbill valve 80 disposed over the opening. The sealed duckbill valve shown in FIG. 7*a* for the first/initial stages of the weaning process may not allow air to flow into the open-ended chamber 66 of the pacifier nipple 58. FIG. 7*b* shows a side view, and FIG. 7*c* illustrates a cross-sectional view of the previous view, demonstrating the sealed valve. It should be noted that despite being sealed, and preventing air to flow into the open-ended chamber of the pacifier nipple, the other sealed chamber 70 of the pacifier nipple is still able to expand, as it still retains one open end, located proximate to the sealed end of the pacifier weaning device which is outside of the user's mouth, thereby allowing air to flow into the chamber for proper nipple expansion.

FIG. 8 (including FIG. 8*a*-8*c*) shows various views of another interchangeable airflow-control component 82, configured to allow air to flow when the corresponding break pressure is achieved, which may replace the component in FIG. 7. FIG. 8*c* illustrates that a small gap 84 is present between flaps of a valve 86 disposed over an opening of an appropriate base 88. This gap may constitute the operative, incremental difference between it and the previous flow-control component used. It is to be understood that this incremental difference, namely, the gap width, could be replaced with a material of different hardness, diaphragm of different length, passageway of different size diameter or length, or the like, to achieve the same desired effect of modifying the break pressure, nipple expansion, partial vacuum, or combination thereof.

FIG. 9 (including FIG. 9*a*-9*c*) shows various views of an interchangeable airflow-control component 90 further modified, to be used in one or more advanced stages of the weaning process where a lower break pressure, a higher flow of air, or a combination thereof, may be beneficial. FIG. 9*c* illustrates a valve 92 disposed over an opening of an appropriate base 94. As shown, the valve of the airflow-control component would have a lower break pressure, according to the gap 96 which has increased in width over the gap 84 shown in FIG. 8. The increase in gap width may cause the valve to open at a moment when the user is exerting a lesser sucking force on the nipple, relative to the which the user would experience with gap width in FIG. 8, thereby causing the valve to open and the chamber to deflate at an earlier stage in the sucking cycle. It is to be understood that this incremental difference, namely, the gap width, could be replaced with a material of different hardness, diaphragm of different length, passageway of different size diameter or length, or the like, to achieve the same desired effect of modifying the break pressure, nipple expansion, partial vacuum, or combination thereof.

In one example, the administrator may begin the weaning process by locating the insert 60, and inserting into its recess 64 the airflow-control component 76 which is fully sealed (such as shown in FIG. 7*a*) in order to permit maximum nipple expansion in the chamber 70 and the creation of a partial vacuum desirable to the user. The administrator could then secure a lid 72 by forcing it back into the pacifier body until the clasps are securely locked, thus sealing the air-flow control component and preventing disassembly of the device by the user.

The user may then utilize the pacifier weaning device 54 including the airflow-control component 76 for a sufficient period of time, becoming accustomed to its tangible properties, until the administrator deems it appropriate to replace the airflow-control component with one that has an incremental difference in its break pressure, flow rate, or combination thereof, such as airflow-control component 82 as depicted in FIG. 8. After sufficient time has elapsed with the second airflow-control component, the administrator may repeat the aforementioned steps in order to replace, once more, the airflow-control component with yet another airflow-control component 90, and may subsequently allow the user to become accustomed to the newly adjusted pacifier accordingly. This process continues, wherein each stage of the weaning process affects the user's ability, in incremental steps, to create a partial vacuum and to expand the pacifier chamber, until the user no longer finds the practice of pacifier sucking pleasurable.

FIG. 10 (including FIGS. 10*a*-10*c*) illustrates various example implementations of a removable airflow-control component, according to other example implementations. FIG. 10*a* shows various views of an airflow-control component that is defined by a single valve 96, which may be a duckbill, umbrella, or any other type of valve, and which may be disposed over an opening of an appropriate base 98. It is to be understood that any physical incremental differences employed could be replaced with incremental differences including, but not limited to, a material of different hardness, diaphragm of different length, passageway of different size diameter or length, or the like, to achieve the same desired effect of modifying the break pressure, nipple expansion, partial vacuum, or combination thereof. FIG. 10*b* shows various views of an airflow-control component that includes a hollow structure 100 that defines a single passageway 102 from an opening in an appropriate base 104, of defined length and diameter. FIG. 10*c* shows various views of an airflow-control component that includes both a valve 106 and a hollow structure defining a passageway 108 over or from an opening in a base 110 (the hollow structure defining the passageway being shown integrated with the base). It is to be understood that any combination of valves and passageways, in any order, and with any multitude of each, can be implemented in the present disclosure.

FIG. 11 (including FIGS. 11*a* and 11*b*) shows additional exploded views of the pacifier weaning device 54 of example implementations of the present disclosure, wherein components and their corresponding positions relative to one another are depicted. FIG. 11*a* shows a general overview of assembly of the pacifier weaning device in which the shell 56 provides a recessed housing for the nipple 58, which is inserted therein, and is sandwiched in place by an insert 60 which in one example can be ultrasonically welded to the shell to prevent removal of the nipple. The insert may receive an airflow-control component 62 into a recess 64. The airflow-control component may be precisely sealed and locked in place by a lid 72, which may define holes 74 to permit the flow of air into the air control component, and from there, into the user's mouth via an open-ended chamber, shown in FIG. 11*b*. It is assumed that air can also flow into the sealed chamber of the pacifier, to allow for the pleasurable expansion of the nipple.

FIG. 11*b* shows another view, wherein the open-ended chamber 66 is visible. A port 68 may be inserted into this chamber, thereby sealing it and ensuring that air flows only from the airflow-control component 62 and into that open-ended chamber. FIG. 11*c* shows a side, cut-out view of the same port, aligned with the open-ended chamber, to demonstrate how it may be inserted. Further, the recess within the insert 64, for the airflow-control component, is also demonstrated. For cleaning purposes, the user may be able to remove the lid 72 and the airflow-control component, to allow for easier access during sterilization.

Further example implementations may utilize a spring-loaded valve such as a spring-loaded ball check valve that may offer adjustment with higher relative resolution, without the need to replace any internal components. Such designs may incorporate a valve assembly which is entirely removable from the pacifier housing assembly, which may facilitate cleaning, or can be designed such that the valve assembly is permanently integrated into the pacifier housing assembly, for greater ease-of-use. A spring-loaded ball check valve allows the user to adjust the break pressure by modifying the tension in an extension spring, or compressive force against a compression spring, which can be accomplished by rotating a bezel, ring, or other threaded component, for example. When a sufficiently negative pressure is applied to the sucking end of the pacifier, the negative pressure may overcome the force of a spring pushing a ball (e.g., rubber ball) against an aperture, which may cause the ball to shift, which may permit the flow of air through the aperture. If the pressure is not sufficient, the ball will continue to create a seal around the aperture. By selectively increasing the amount of force which compresses the spring, the sucking force required to break the pressure becomes higher, therefore requiring greater sucking force to break the seal. Thus, the user is able to control the break pressure without replacing any internal components.

FIG. 12 (including FIGS. 12*a*-12*d*) shows fully assembled and exploded views of an example according to this further implementation which utilizes an airflow-control component within a removable valve assembly that includes an adjustable spring-loaded ball check valve. This configuration facilitates cleaning of the device by exposing the inner surfaces when the valve assembly is removed, and also preserves the valve settings during use by preventing access to the adjustable spring-loaded ball check valve when the device is fully assembled. In this implementation, as with previous implementations, the pacifier weaning device includes a shell 112 adapted to hold a nipple 58, which is inserted therein, and sandwiched in place by an insert 114 that in one example can be ultrasonically welded to the shell. This insert, via a round flange 116 at the top, may also retain a bezel 118 such as a threaded bezel, which in some examples can freely rotate. Keys 120 connect the bottom of the insert to the flange, and may interface with one or more slots 122 cut into an outer valve housing 124, preventing the valve housing and the rest of the valve assembly from rotation when it is inserted into a shell assembly.

In this implementation, the shell 112 and bezel 118 may form the shell assembly that provides the housing for the nipple 58 and removable valve assembly, which may include the outer valve housing 124, an inner member 126, and a spring-loaded valve including spring 128 and structure such as a ball 130 (e.g., rubber ball). The inner member may be configured to move axially within the outer valve housing, with the spring and structure of the spring-loaded valve being further in the interior of the outer valve housing.

After removing the valve assembly from the shell assembly, then, the user may adjust the valve assembly to define a break pressure for airflow through the open-ended chamber 66 of the nipple 58. For example, the user may adjust the inner member 126, which alters compression of the spring 128 and thereby a force that the ball 130 pushes upon an aperture 132 at the top of the valve housing 124, and in turn adjusting the break pressure at which airflow through the aperture and open-ended chamber is permitted. In some examples, the diameter of the aperture or a passageway from the aperture through the valve housing may define the airflow rate through the open-ended chamber.

As suggested above, in other more general examples, the spring-loaded ball check valve may be a spring-loaded valve including a structure such as a ball, cone or other similar structure which may push upon the aperture 132 by an applied force from a spring, which may include any of a number of elastic structures capable of storing mechanical energy.

Although shown as threading into the interior of the outer valve housing 124, it should be understood that the inner member 126 may be designed to secure the spring-loaded ball check valve (spring 128 and ball 130) within the valve housing in any of a number of different manners. For example, the inner member may instead thread or snap onto the outside of the valve housing, which may permit other manners of its adjustment including without being threaded into the valve housing. In another example, an inner member inside the valve assembly may allow the spring to relax when the valve assembly is removed from the shell assembly such that when the administrator inserts the valve assembly back into the shell assembly, the spring may be compressed to a specific setting.

FIG. 13 shows how a removable valve assembly and dual-chambered pacifier nipple can permit the use of a removable accessory attachment designed for delivery of food through the pacifier weaning device and open-ended chamber 66 of the nipple 58. In some examples, this may be accomplished by removing the entire valve assembly from the shell assembly and replacing it with an attachment designed to facilitate bottle feeding, or by selectively modifying the valve assembly to accept a further attachment designed for feeding. In some examples, the bezel 118 of the shell assembly may seal directly against the threaded shaft of a feeding bottle. In other examples, an included attachment 134 may be attached to the bezel, and either connect to a feeding bottle directly, or provide a barbed protrusion 136 for connection with one end of a tube (not pictured), with the other end of the tube in a baby bottle. Any of these examples may permit the flow of liquid from the bottle, through the bezel, and through the open-ended channel 66 in the nipple 56, directly into the user's mouth, via the same natural behavior that a user instinctively expects to generate milk from breast feeding.

As shown in FIG. 13, the barbed protrusion 136 is projected from the attachment having a shape the same as or similar to the outer valve housing 124 as in FIG. 12, which may provide the additional benefit of allowing the user to control the amount of suction required to generate the desired flow of liquid. This can be accomplished via the same methods used to control the airflow, namely, by adjusting a component to either increase or decrease compression on a spring, which provides force upon a ball pushing against a passageway. Having this adjustability in liquid flow can be used to prevent otitis media, or ear infection, which can be more prone to occur when a user applies a higher sucking force on the pacifier. Regardless, in any specified or unspecified implementation, by incorporating an attachment for feeding, the device may promote a developed preference for the shape and use of the pacifier, which may enable higher success rates when the time comes to wean the user off of the pacifier using the valve housing assembly.

Similar to the inner member 126, it should be understood that although the outer valve housing 124 and food-delivery accessory attachment (e.g., barbed protrusion 136) are shown as being threaded within the bezel 118, they may be removably securable to the bezel in any of a number of different manners, and may not be threaded. For example, the outer valve housing and food-delivery accessory attachment may instead thread or snap into the inside or onto the outside of the bezel.

Many modifications and other implementations of the disclosure will come to mind to one skilled in the art to which this disclosure pertains having the benefit of the teachings presented in the foregoing descriptions and the associated drawings. For example, it is to be understood that various means for fastening the various components of this disclosure together may be used or that various parts of the disclosure can be assembled as a single integral unit. Furthermore, configurations described herein may be combined, such as by having two sets of air-flow control components, one that may be embedded at the sucking end and another may be removable at the non-sucking end. It should therefore be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A pacifier weaning apparatus comprising:

a shell or shell assembly providing a housing;

a nipple configured to protrude from the housing, the nipple including a first end adapted to be held by the housing, and an opposing, sucking end adapted for insertion into a user's mouth, the nipple defining a first chamber and an expandable, second chamber that are both open at the first end and extend in a direction from the first end to the sucking end, the first chamber being open and the second chamber being closed at the sucking end; and an airflow-control component configured to regulate either or both a break pressure at or above which airflow through the first chamber is permitted, or a rate of airflow through the first chamber, the airflow-control component being configured to permit, or interchangeable with one or more additional airflow-control components to permit, incrementally different break pressures, airflows, or combinations thereof.

2. The pacifier weaning apparatus of claim 1, wherein the airflow-control component includes a valve configured to regulate the break pressure, or defines a passageway configured to regulate the rate of airflow, or both includes the valve and defines the passageway.

3. The pacifier weaning apparatus of claim 1, wherein the airflow-control component is integrated with the nipple and located proximate the sucking end thereof.

4. The pacifier weaning apparatus of claim 1, wherein the airflow-control component is configured to fit within the housing proximate the first end of the nipple.

5. The pacifier weaning apparatus of claim 4, wherein the airflow-control component is removable from the housing and interchangeable with the one or more additional airflow-control components each of which is also configured to fit within the housing, the airflow-control component and one or more additional airflow-control components structurally defining different, respective break pressures or rates of airflow.

6. The pacifier weaning apparatus of claim 4, wherein the airflow-control component is removable from the housing and provides an adjustable break pressure or rate of airflow.

7. The pacifier weaning apparatus of claim 1, wherein the airflow-control component comprises a removable valve assembly securable to the housing, the removable valve assembly comprising:

an outer valve housing securable to the housing, and defining an aperture; and a spring-loaded valve configured to push upon the aperture with an adjustable force, and thereby an adjustable break pressure at which airflow through the aperture and first chamber is permitted.

8. The pacifier weaning apparatus of claim 7, wherein the outer valve housing includes an interior within which the spring-loaded valve is configured to fit, wherein the spring-loaded valve includes a spring and a structure, and wherein the removable valve assembly further comprises an inner member configured to move axially within the interior of the outer valve housing with the spring-loaded valve between the aperture and inner member, adjustment of the inner member altering compression of the spring and thereby a force that the structure pushes upon the aperture.

9. A pacifier weaning apparatus comprising:

a removable airflow-control component;

a shell or shell assembly providing a housing; and a nipple configured to protrude from the housing, the nipple including a first end adapted to be held by the housing, and an opposing, sucking end adapted for insertion into a user's mouth, the nipple defining a first chamber and an expandable, second chamber that are both open at the first end and extend in a direction from the first end to the sucking end, the first chamber being open and the second chamber being closed at the sucking end, wherein the housing defines a recess that opens opposite the nipple when held by the housing, the recess being configured to hold a plurality of interchangeable accessories including the removable airflow-control component, or a combination of the removable airflow-control component and an attachment for delivery of food through the housing and first chamber, the airflow-control component being configured to regulate either or both a break pressure at or above which airflow through the first chamber is permitted, or a rate of airflow through the first chamber, the airflow-control component being configured to permit, or interchangeable with one or more additional airflow-control components to permit, incrementally different break pressures, airflows, or combinations thereof.

10. The pacifier weaning apparatus of claim 9 further comprising:

an insert configured to fit in the recess of the housing and fasten the nipple to the housing, the insert defining a recess configured to hold the removable airflow-control component or attachment.

11. The pacifier weaning apparatus of claim 10, wherein the insert includes a lid for locking the removable airflow-control component in place when held in the recess defined by the insert.

12. The pacifier weaning apparatus of claim 9, wherein the removable airflow-control component or attachment is removably securable at least partially within the recess defined by the housing.

13. The pacifier weaning apparatus of claim 9, wherein the plurality of interchangeable accessories includes the airflow-control component and the one or more additional airflow-control components that structurally define different, respective break pressures at which airflow through the first chamber is permitted, or rates of airflow through the first chamber.

14. A pacifier weaning apparatus comprising:

a shell or shell assembly providing a housing;

a nipple configured to protrude from the housing, the nipple including a first end adapted to be held by the housing, and an opposing, sucking end adapted for insertion into a user's mouth, the nipple defining a first chamber and an expandable, second chamber that are both open at the first end and extend in a direction from the first end to the sucking end, the first chamber being open and the second chamber being closed at the sucking end; and an airflow-control component to fit within the pacifier weaning apparatus, the airflow-control component comprising:

a base defining an opening; and at least one of a valve disposed over the opening, or a hollow structure defining a passageway from the opening, wherein when the airflow-control component is fit within the pacifier weaning device, the at least one of the valve or the hollow structure is configured to regulate a break pressure at or above which airflow through the first chamber is permitted, and the passageway is configured to regulate a rate of airflow through the first chamber, the airflow-control component being interchangeable with one or more additional airflow-control components to permit incrementally different break pressures, airflows, or combinations thereof.

15. The pacifier weaning apparatus of claim 14, wherein the airflow-control component includes the valve.

16. The pacifier weaning apparatus of claim 14, wherein the airflow-control component includes the hollow structure that defines the passageway.

17. The pacifier weaning apparatus of claim 14, wherein the airflow-control component includes both the valve and the hollow structure that defines the passageway.

18. The pacifier weaning apparatus of claim 14, wherein the airflow-control component is removable from the housing and interchangeable with the one or more additional airflow-control components each of which is also configured to fit within the housing, the airflow-control component and one or more additional airflow-control components structurally defining different, respective break pressures or rates of airflow.

19. A pacifier weaning apparatus comprising:

a shell or shell assembly providing a housing;

a nipple configured to protrude from the housing, the nipple including a first end adapted to be held by the housing, and an opposing, sucking end adapted for insertion into the user's mouth, the nipple defining a first chamber and an expandable, second chamber that are both open at the first end and extend in a direction from the first end to the sucking end, the first chamber being open and the second chamber being closed at the sucking end; and an airflow-control component comprising a removable valve assembly securable to the pacifier weaning apparatus, wherein the removable valve assembly comprises:

an outer valve housing securable to the housing, and defining an aperture; and a spring-loaded valve configured to push upon the aperture with an adjustable force, and thereby an adjustable break pressure at which airflow through the aperture and first chamber is permitted, the airflow-control component being configured to permit incrementally different break pressures, airflows, or combinations thereof.

20. The pacifier weaning apparatus of claim 19, wherein the outer valve housing includes an interior within which the spring-loaded valve is configured to fit, wherein the spring-loaded valve includes a spring and a structure, and wherein the removable valve assembly further comprises an inner member configured to move axially within the interior of the outer valve housing with the spring-loaded valve between the aperture and inner member, adjustment of the inner member altering compression of the spring and thereby a force that the structure pushes upon the aperture.

* * * * *